US010976710B2

(12) United States Patent
Gueissaz et al.

(10) Patent No.: US 10,976,710 B2
(45) Date of Patent: Apr. 13, 2021

(54) WATCH PROVIDED WITH A THERMOELECTRIC BUTTON

(71) Applicant: The Swatch Group Research and Development Ltd, Marin (CH)

(72) Inventors: Francois Gueissaz, Cormondreche (CH); Alain Jornod, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 135 days.

(21) Appl. No.: 15/834,135

(22) Filed: Dec. 7, 2017

(65) Prior Publication Data

US 2018/0173169 A1 Jun. 21, 2018

(30) Foreign Application Priority Data

Dec. 20, 2016 (EP) ..... 16205234

(51) Int. Cl.
*G04G 21/08* (2010.01)
*G04C 3/00* (2006.01)

(52) U.S. Cl.
CPC ..... *G04G 21/08* (2013.01); *G04C 3/001* (2013.01)

(58) Field of Classification Search
CPC ..... G04C 3/001; G04G 21/08
See application file for complete search history.

(56) References Cited

U.S. PATENT DOCUMENTS 4,106,279 A 8/1978 Martin et al.
2003/0007424 A1 1/2003 Watanabe et al.
2011/0155478 A1* 6/2011 Choi ..... H03K 17/96 178/18.03
2013/0027320 A1* 1/2013 Chang ..... G09B 21/007 345/173
2013/0215066 A1* 8/2013 Fertl ..... G04G 9/0064 345/173

(Continued)

FOREIGN PATENT DOCUMENTS

EP 1 227 375 A1 7/2002
FR 2 310 589 12/1976

OTHER PUBLICATIONS

European Search Report dated Jul. 3, 2017 in European Application 16205234.4, filed on Dec. 20, 2016 (with English Translation of Categories of cited documents).

*Primary Examiner* — Daniel P Wicklund
(74) *Attorney, Agent, or Firm* — Oblon, McClelland, Maier & Neustadt, L.L.P.

(57) ABSTRACT

A device is provided, including a housing having a cavity that is open to an exterior of the housing; an electrical element positioned inside the housing; and an actuation system configured to actuate the element and including a thermoelectric module including first and second electrically insulating plates substantially parallel to one another and each bear electrically conductive terminal blocks, and semi-conductive pillars that extend between the respective blocks of the first and second plates, the module housed inside the cavity such that the second plate is positioned against walls of the cavity and the first plate is accessible from outside the housing, and an electronic transmission circuit linking at least two of the blocks of the second plate to the element, and where the system extends beyond the exterior of the housing in a direction perpendicular to a plane aligned with a surface of the exterior of the housing.

9 Claims, 1 Drawing Sheet

(56) References Cited

U.S. PATENT DOCUMENTS

| | | | | |
|---|---|---|---|---|
| 2014/0055356 | A1* | 2/2014 | Wu | G06F 1/26 345/163 |
| 2016/0126442 | A1* | 5/2016 | Yeh | H01L 35/32 307/43 |
| 2016/0154484 | A1* | 6/2016 | Kampf | G06F 3/03545 345/179 |
| 2016/0251992 | A1* | 9/2016 | Kim | F01N 5/025 136/205 |
| 2017/0045958 | A1* | 2/2017 | Battlogg | F16D 37/02 |
| 2017/0365766 | A1* | 12/2017 | Boukai | G04G 19/00 |
| 2018/0351069 | A1* | 12/2018 | Boukai | H01L 35/30 |

* cited by examiner

WATCH PROVIDED WITH A THERMOELECTRIC BUTTON

CROSS-REFERENCE TO RELATED APPLICATION

This application claims priority from European Patent Application No. 16205234.4 filed on Dec. 20, 2016; the entire disclosure of which is incorporated herein by reference

FIELD OF THE INVENTION

The invention relates to a device (for example a watch, a telephone, a remote control, etc.) provided with an actuation system making it possible to activate an electrical element of said device (the electrical element is for example an LED, an antenna for transmitting electromagnetic waves, timing means, etc.).

BACKGROUND OF THE INVENTION

It is known practice to activate an electrical element of a device by actuating a pushbutton. For example, it is known practice to activate means for illuminating the dial of a watch by actuating a pushbutton located on the outside of the case, to activate an antenna for transmitting a remote control command via a remote control button for example in order to control an audiovisual device or a lamp. The actuation of the pushbutton causes electrical contact to be made between an energy source (generally a battery) and the electrical element (a light source, generally a light-emitting diode, an infrared optical or radiofrequency transmission element, etc.).

However, this system requires the use of an exhaustible electrical energy source (the battery).

SUMMARY OF THE INVENTION

The aim of the present invention is to overcome the aforementioned drawback.

To this end, the invention relates to a device comprising:

a housing having a cavity that is open to the exterior of the housing an electrical element positioned inside the housing an actuation system for actuating the electrical element, comprising:

- a thermoelectric module including first and second electrically insulating plates, which plates are substantially parallel to one another and bear electrically conductive terminal blocks, and semiconductive pillars that extend between the terminal blocks of the first plate and the terminal blocks of the second plate, the thermoelectric module being housed inside the cavity such that the second plate is positioned against walls of the cavity and the first plate is accessible from outside the housing
- an electronic transmission circuit linking two terminal blocks of the second plate to the electrical element.

The first plate is initially at the temperature of the surroundings of the device, and the second plate is initially at the temperature of the housing since it is positioned against a wall of the cavity of the housing. When the first plate is warmed up, for example through the transmission of the natural warmth given off by a finger placed on the first plate, by rubbing the finger on the first plate, or by actuating an intermediate plate that itself creates friction with the first plate, a difference in temperature between the first and the second plate arises. The temperature gradient results in a difference in electrical potential, via the Seebeck effect, between the terminal blocks of the first plate and the terminal blocks of the second plate. This difference in electrical potential is subsequently communicated to the electrical element via the electronic transmission circuit. The actuation system therefore behaves like a thermoelectric pushbutton that is without moving parts, is completely sealed and can be used for both mechanical watches and electronic watches.

It should be noted that using a converter placed at the output of the thermoelectric element and capable of converting voltages of the order of millivolts into voltages of the order of volts, if the device is located in surroundings at a temperature that is lower than that of the human body, just the contact of a finger with the first plate is enough to generate electrical power that is sufficient to produce visible light using a light-emitting diode. However, if the device is worn on the body or is located in surroundings at a temperature that is higher than that of the human body, it is necessary to rub the first plate in order to generate such power.

In accordance with advantageous embodiments of the invention, the device may have the following features, taken alone or in any technically feasible combination.

In one non-limiting embodiment, the first plate consists of or includes a layer consisting of a material having a high coefficient of friction.

In one non-limiting embodiment, the electronic transmission circuit includes a DC-to-DC converter and two electrical wires passing through the housing, each wire being linked both to a terminal block of the second plate and to said converter.

In one non-limiting embodiment, the electronic transmission circuit includes an accumulator that is placed at the output of the DC-to-DC converter, and a control unit that is connected both to the accumulator and to the electrical element for the purpose of discharging the accumulator when its charge exceeds a threshold value.

In one non-limiting embodiment, the accumulator is a capacitor.

In one non-limiting embodiment, the actuation system includes an electric insulator layer that is positioned between the first plate and the second plate and laterally covers the thermoelectric module.

In one non-limiting embodiment, the actuation system includes an intermediate plate and means for moving the intermediate plate against the first plate.

In one non-limiting embodiment, the device is a wristwatch.

In one non-limiting embodiment, the device is a remote control.

In one non-limiting embodiment, the device is a wireless wall switch.

In one non-limiting embodiment, the electrical element includes a light-emitting diode.

In one non-limiting embodiment, the electrical element includes a radiofrequency transmitter.

BRIEF DESCRIPTION OF THE DRAWINGS

Other particularities and advantages will become clearly apparent from the description thereof provided below by way of completely non-limiting indication and with reference to the appended drawings, in which.

DETAILED DESCRIPTION OF PREFERRED EMBODIMENTS

Figure 1:
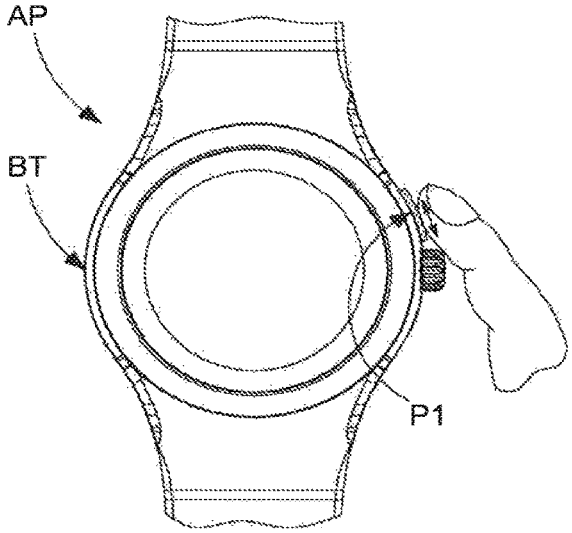
FIG. 1 is a diagram of the principle of a thermoelectric pushbutton borne by a watch according to one embodiment of the invention.

FIG. 1 illustrates a device AP, which, in the present case, is a wristwatch. Of course, the device AP is not necessarily a watch, but could be another type of device, for example a telephone, a remote control, or a wireless wall switch. The watch AP includes a housing BT inside which an electrical element EL (shown in FIG. 4) is located. The electrical element EL is for example a light-emitting diode or a set of light-emitting diodes used to illuminate the dial of the watch, or a radiofrequency transmitter. In one non-limiting embodiment, the electrical element consists of a set of diodes, each diode being placed at one of the hour markers. Of course, the electrical element EL is not necessarily a diode or a set of diodes. The electrical element EL is more generally any means for activating a function, for engaging a mode, etc.

Figure 2:
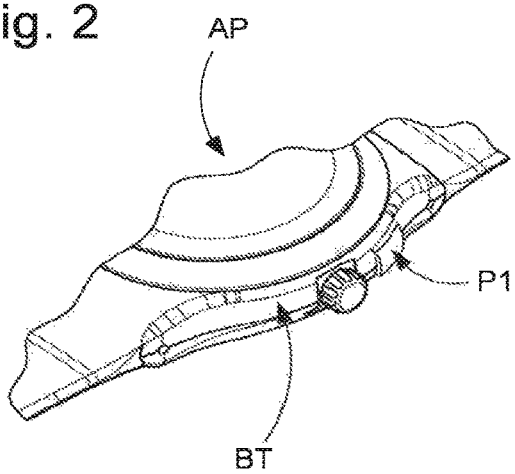
FIG. 2 is a side view of the watch of FIG. 1.
Figure 3:
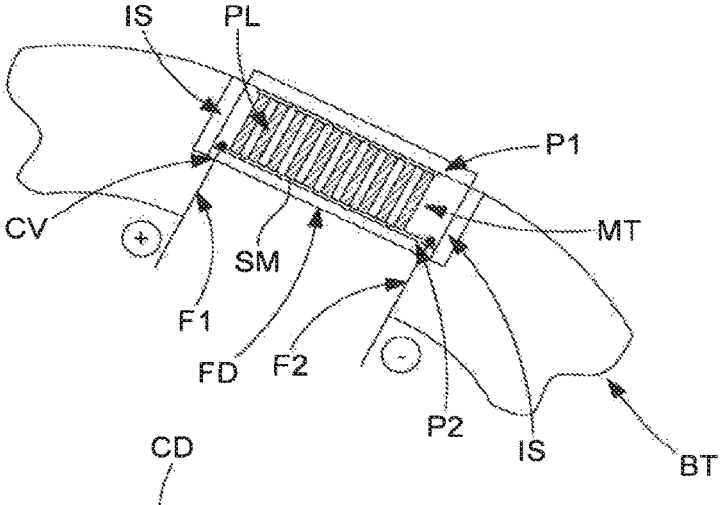
FIG. 3 is a schematic representation of the thermoelectric button of FIG. 1.

The watch AP bears an actuation system SA (shown in FIG. 4) for actuating the electrical element EL, also referred to as a thermoelectric pushbutton, a portion P1 of which can be seen in FIGS. 1 and 2. As shown in detail in FIG. 3, the actuation system SA includes:

- a thermoelectric module MT that is positioned for example on a lateral area of the housing BT, in the conventional place for a pushbutton
- an electrical transmission circuit CT, passing through the housing BT and linking the thermoelectric module MT to the electrical element EL.

The thermoelectric module MT is positioned in a cavity CV that is made in the lateral area of the housing BT and is open to the exterior of the housing BT, i.e. the external portion of the watch AP. In a known and conventional manner, the thermoelectric module MT includes first P1 and second P2 electrically insulating plates. The first plate P1 bears a plurality of electrically conductive terminal blocks SM that are positioned one next to the other. Similarly, the second plate P2 bears a plurality of electrically conductive terminal blocks SM that are positioned one next to the other. Each terminal block of the first plate P1 is linked to two terminal blocks of the second plate P2 by a pair of semiconductive pillars PL so as to take as full advantage as possible of the Seebeck effect. Each pair of pillars PL includes an n-doped semiconductor and a p-doped semiconductor. The first plate P1 and the second plate P2 extend substantially in parallel to one another, and the pillars PL extend substantially orthogonally to the plates P1, P2.

The second plate P2, forming the cold pole of the thermoelectric module MT, is positioned against the bottom FD of the cavity CV. The first plate P1, facing the second plate P2, is therefore accessible from outside the housing BT. The first plate P1 forms the warm pole of the thermoelectric module MT. Applying a temperature gradient through the thermoelectric module, by warming the first plate P1, leads to the diffusion of charge carriers towards the second plate P2, which then generates a voltage. The actuation system SA also includes a thermal insulator layer IS that is positioned all around the thermoelectric module MT, between the first and the second plates P1, P2.

The first plate P1 is for example warmed up by rubbing it with a finger, as shown in FIG. 1. The first plate P1 then advantageously consists of or is covered by a material having a high coefficient of friction. However, in cases in which the watch is located in surroundings that are sufficiently cold, just the contact of a finger with the first plate P1 may be enough to create a temperature gradient that is sufficient to generate a voltage of a few millivolts at the output of the thermoelectric module MT.

In one alternative embodiment, the actuation system SA includes an intermediate plate and means for moving the intermediate plate against the first plate P1, for example springs. A user then does not have to touch or rub the first plate P1, which has a high coefficient of friction and is therefore not pleasing to the touch, but only has to move the intermediate plate, which itself will rub against the first plate P1. The intermediate plate is advantageously made of a material that is pleasing to the touch, for improved user comfort.

Figure 4:
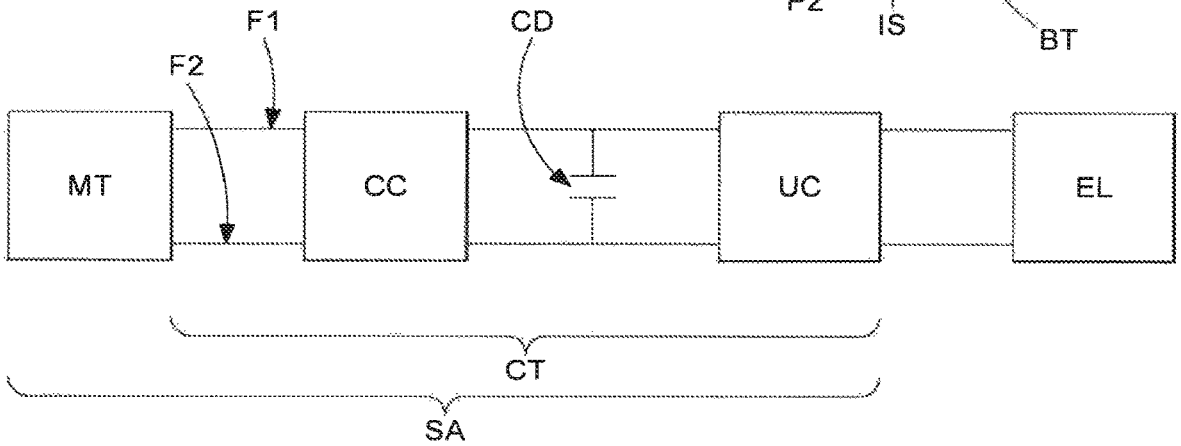
FIG. 4 is a schematic representation of an electronic transmission circuit forming part of the thermoelectric button of FIG. 1.

With reference to FIG. 4, the electronic transmission circuit CT includes:

- two electrical wires F1, F2 that are connected to two terminal blocks SM of the second plate P2 such that the semiconductive pillars PL are in series between these two terminal blocks. These two terminal blocks form electrical terminals. The electrical wires F1, F2 pass through the housing.
- a DC-to-DC converter CC that is connected between said two wires F1, F2 and positioned inside the housing BT, for the purpose of increasing the voltage generated by the thermoelectric module MT. Typically, the DC-to-DC converter CC is configured to convert voltages of the order of millivolts into voltages of the order of volts.
- an accumulator CD, in the present case a simple buffer capacitor, although this embodiment is not limiting, at the output of the DC-to-DC converter CC,
- a control unit UC for discharging the accumulator CD when its charge exceeds a threshold value, the current delivered by discharging the accumulator CD being delivered to the electrical element EL in order to supply it with power.

Of course, the present invention is not limited to the illustrated example has the potential for various alternative embodiments and modifications that will be apparent to those skilled in the art.

What is claimed is:

1. A device, comprising:

a housing having a cavity that is open to an exterior of the housing;

an electrical element positioned inside the housing; and an actuation system configured to actuate the electrical element, the actuation system comprising:

a thermoelectric module including first and second electrically insulating plates, which are substantially parallel to one another and each bear electrically conductive terminal blocks; and semiconductive pillars that extend between the electrically conductive terminal blocks of the first electrically insulating plate and the electrically conductive terminal blocks of the second electrically insulating plate, the thermoelectric module being housed inside the cavity such that the second electrically insulating plate is positioned against walls of the cavity and the first electrically insulating plate is accessible from outside the housing, and an electronic transmission circuit linking at least two of the electrically conductive terminal blocks of the second electrically insulating plate to the electrical element, wherein the actuation system is disposed directly adjacent to a crown disposed on only one side of the housing, and extends beyond the exterior of the housing on the only one side thereof in a direction perpendicular to a plane aligned with a surface of the exterior of the housing.

2. The device according to claim 1, wherein the first electrically insulating plate includes a layer consisting of material having a coefficient of friction such that a temperature of the first electrically insulating plate is increased by being rubbed by a user.

3. The device according to claim 1, wherein the electronic transmission circuit includes a DC-to-DC converter and two electrical wires passing through the housing, each wire being linked both to a terminal block of the second electrically insulating plate and to said DC-to-DC converter.

4. The device according to claim 3, wherein the electronic transmission circuit includes an accumulator that is placed at an output of the DC-to-DC converter, and a control unit that is connected both to the accumulator and to the electrical element for discharging the accumulator when a charge thereof exceeds a threshold value.

5. The device according to claim 4, wherein the accumulator is a capacitor.

6. The device according to claim 1, wherein the actuation system further comprises an electrical insulator layer that is positioned between the first electrically insulating plate and the second electrically insulating plate and laterally covers the thermoelectric module.

7. The device according to claim 1, wherein the device is a wristwatch.

8. The device according to claim 1, wherein the electrical element includes a light-emitting diode.

9. The device according to claim 1, wherein the electrical element includes a radiofrequency transmitter.

* * * * *